US009120301B2

(12) United States Patent
Moreland

(10) Patent No.: US 9,120,301 B2
(45) Date of Patent: Sep. 1, 2015

(54) MAGNETIC ROLL

(75) Inventor: G. Steven Moreland, Newton, KS (US)

(73) Assignee: Bunting Magnetics Co., Newton, KS (US)

( * ) Notice: Subject to any disclaimer, the term of this patent is extended or adjusted under 35 U.S.C. 154(b) by 644 days.

(21) Appl. No.: 12/947,972

(22) Filed: Nov. 17, 2010

(65) Prior Publication Data

US 2012/0118180 A1 May 17, 2012

(51) Int. Cl.
*B41F 27/02* (2006.01)

(52) U.S. Cl.
CPC ..... *B41F 27/02* (2013.01); *B31F 2201/073* (2013.01)

(58) Field of Classification Search
CPC .... B41F 27/005; B41F 27/02; B41F 27/1275; B41F 27/06; B31F 220/073; B31F 2201/073
USPC ..... 101/23, 481, 389.1, 382.1, 28, 32, 101/415.1, 486, 378, 485, DIG. 36; 33/621, 33/620, 617
IPC ..... B31F 1/07
See application file for complete search history.

(56) References Cited

U.S. PATENT DOCUMENTS

| | | | | |
|---|---|---|---|---|
| 4,154,167 | A | 5/1979 | Czinger | |
| 4,589,338 | A | 5/1986 | Collins et al. | |
| 5,156,091 | A | 10/1992 | Bätz | |
| 5,284,092 | A | 2/1994 | Simeth | |
| 5,315,929 | A | 5/1994 | Sundqvist | |
| 5,317,968 | A * | 6/1994 | Saitou et al. | 101/415.1 |
| RE35,647 | E | 11/1997 | Simeth | |
| 6,016,752 | A | 1/2000 | Harari | |
| 6,299,572 | B1 | 10/2001 | Harari | |
| 6,443,065 | B1 | 9/2002 | Charette et al. | |
| 6,748,862 | B2 * | 6/2004 | Frankenberger et al. | 101/382.1 |
| 7,621,219 | B2 | 11/2009 | Burgess et al. | |
| 2007/0227379 | A1 * | 10/2007 | Sato et al. | 101/389.1 |
| 2010/0162910 | A1 | 7/2010 | Malm et al. | |

FOREIGN PATENT DOCUMENTS

| | | |
|---|---|---|
| DE | 4205460 | 6/1993 |
| DE | 4208320 | 6/1993 |
| JP | 60085957 | 5/1985 |
| WO | WO 2008076034 A1 * | 6/2008 |

* cited by examiner

*Primary Examiner* — Jennifer Simmons
(74) *Attorney, Agent, or Firm* — Kenneth H. Jack; Davis & Jack, L.L.C.

(57) ABSTRACT

A roll for supporting at least a first flexible printing, embossing, or sheet cutting die plate, the roll including a cylindrical body having a rotational axis and an outer circumferential surface, the cylindrical body being divided into segments; a first magnet receiving concavity and magnet combination emitting plate attaching magnetic flux at a first circumferential surface segment overlying a first cylindrical body segment; a second magnet receiving concavity and magnet combination, further emitting plate attaching magnetic flux at a second circumferential surface overlying a second cylindrical body segment; plate edge aligning pins connected operatively to the first cylindrical body segment; and segment positioning cam and socket combinations adapted for selectively positioning and repositioning both the first cylindrical body segment and the plate edge aligning pins with respect to the second cylindrical body segment.

10 Claims, 3 Drawing Sheets

MAGNETIC ROLL

FIELD OF THE INVENTION

This invention relates to magnetic rolls which are adapted for securely holding and driving ferro-magnetic and flexible printing dies, embossing dies, and sheet material cutting dies. More particularly, this invention relates to adaptations of such rolls for achieving correctly positioned and aligned magnetic attachments of such dies to the outer circumferential surfaces of such rolls.

BACKGROUND OF THE INVENTION

Magnetic print rolls for magnetic attachment, support, and driving carriage of ferro-magnetic flexible printing plates, embossing dies, or sheet cutting dies commonly present radially outwardly extending register pins. Such pins conventionally serve a function of engaging pin receiving eyes or apertures positioned along and extending through a leading edge of a flexible ferro-magnetic plate to be attached to the roll. Upon engagement of such register pins with such eyes or apertures, a correct alignment of the plate's edge is desirably produced. Thereafter, the flexible ferro-magnetic plate may be wrapped about the magnetic roll to produce a secure and correctly aligned magnetic plate attachment from the leading edge of the plate to its trailing edge. In many circumstances, small deviations in plate position away from a properly aligned orientation may be corrected by manipulating the conventionally provided roll position adjustment mechanisms of a printing press in which the magnetic roll is installed.

Where a magnetic roll is used for magnetically attaching, supporting, and driving a matched pair of ferro-magnetic flexible printing plates (each extending semi-circumferentially about the roll), two pairs of such plate aligning register pins are conventionally provided, one pair of register pins being used to establish the alignment of each plate upon the roll. However, upon installing a pair of such plates, an operator often finds that the printing press's print roll alignment mechanisms are incapable of correctly aligning both plates among the pair. The operator may manipulate the press's roll position adjustment mechanism to achieve a correct position and alignment of a first plate among such pair without achieving a correct alignment of the second plate. Instead of achieving a correct alignment of the second plate, a printing press actuated correct alignment of the first plate may exacerbate any misalignment of the second plate.

The instant inventive magnetic roll solves or ameliorates the problems, defects, and deficiencies discussed above by specially adapting a magnetic roll for adjustment and movement of a pair of its register pins by incorporating within the roll a moveable plate mechanism, such mechanism being consonant with and avoiding any significant interruption of needed continuity of plate attaching magnetic field strength at the circumferential locus of such mechanism.

BRIEF SUMMARY OF THE INVENTION

A first structural component of the instant inventive magnetic roll comprises a cylindrical body having a rotational axis and an outer circumferential surface. The magnetic roll's cylindrical body is specially configured to comprise a plurality of segments, and in a preferred embodiment, two segments are provided. Preferably, a first magnetic roll cylindrical body segment takes the form of a slide plate having a substantially flat radially inner surface, and having an arcuately curved radially outer surface. The radius of curvature of the first segment's outer surface preferably matches that of the magnetic roll and the axial length of the first segment also preferably matches that of the roll.

The instant inventive roll's second cylindrical body segment preferably constitutes the substantial entirety of the remainder of the roll, such second cylindrical body segment presenting or forming and defining a radially outwardly opening channel having a flat channel floor upon which the first cylindrical body segment may slidably move.

The circumferential or radially outer surfaces of the first and second cylindrical body segments preferably present a matrix or array of magnet receiving concavity and magnets combinations, such matrix or array preferably being continuous over and being substantially uninterrupted at the circumferential outer surface of the plate configured first cylindrical body segment.

Plate edge aligning means are preferably fixedly attached to or formed wholly with the first cylindrical body segment. In a preferred embodiment, the plate edge aligning means comprise an axially aligned pair of radially outwardly extending register pins. Alternatively, where a ferro-magnetic plate to be attached to the roll presents radially inwardly extending plate edge aligning members (as opposed to presenting register pin receiving eyes or apertures), the plate edge aligning means may suitably comprise sockets or recesses within the first body segment, such sockets or recesses being fitted for receiving such plate edge aligning members.

A further structural component of the instant inventive magnetic roll comprises body segment positioning means which are connected operatively to the first cylindrical body segment. In a preferred embodiment, such means comprise a plurality of rotatable cam and cam receiving socket combinations, such combinations operatively spanning between and interconnecting the first and second cylindrical body segments. Through wrench or screw driver actuated rotations of the cams of such combinations within such combinations' sockets, the position and alignment of the plate configured first cylindrical body segment may be precisely slidably adjusted. Cam rotating adjustments of the first body segment advantageously result in precise positioning of both the first body segment's plate edge aligning means and a magnetically attached ferro-magnetic printing plate whose circumferentially wrapped attachment to the roll is initially correctly guided and aligned by the plate edge aligning means.

While cam and socket combinations constitute a preferred segment positioning means, other means for mechanically adjusting the position and alignment of the plate configured first cylindrical body segment with respect to the second cylindrical body segment are considered to fall within the scope of the invention.

Releasable locking means are preferably provided as an additional component of the instant invention's body segment position means, the releasable locking means securely latching or locking the plate configured first cylindrical body segment at a correct position and alignment which may be produced through cam rotations as described above.

In a preferred embodiment, a plurality (preferably four) of rotatable cam and socket combinations are provided. The instant invention advantageously allows such preferred four rotatable cam and socket combinations, in addition to a pair of plate position locking bolts, to be incorporated within an array of magnets mounted within concavities within the plate segment's circumferential outer surface, and without any substantial interruption of magnetic field strength at and along such surface. Non-interruption of magnet field strength at such surface is important as leading and trailing edges of magnetically attached ferro-magnetic plates typically reside at such surface, and strength of magnetic attachment is crucial at such plate edges.

Accordingly, it is an object of the invention to provide a magnetic roll which incorporates the structures described above, and which arranges such structures in relation to each other, in manners described above, for the performance of functions and for achievement of the benefits described above.

Other and further objects, benefits, and advantages of the present invention will become known to those skilled in the art upon review of the Detailed Description which follows, and upon review of the appended drawings.

DETAILED DESCRIPTION OF A PREFERRED EMBODIMENT

Figure 1:
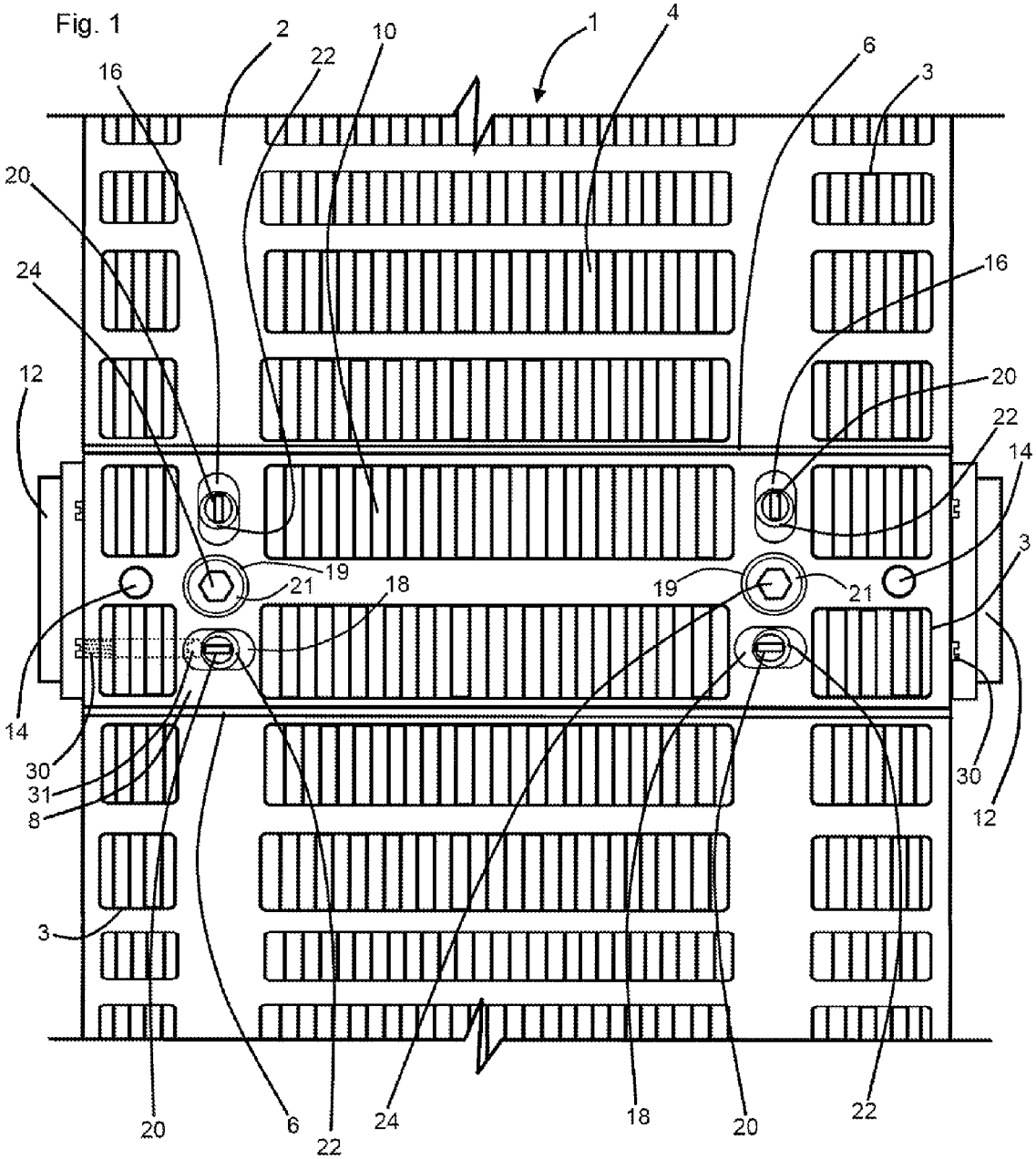
FIG. 1 is a partial side view of a preferred embodiment of the instant inventive magnetic roll.
Figure 2:
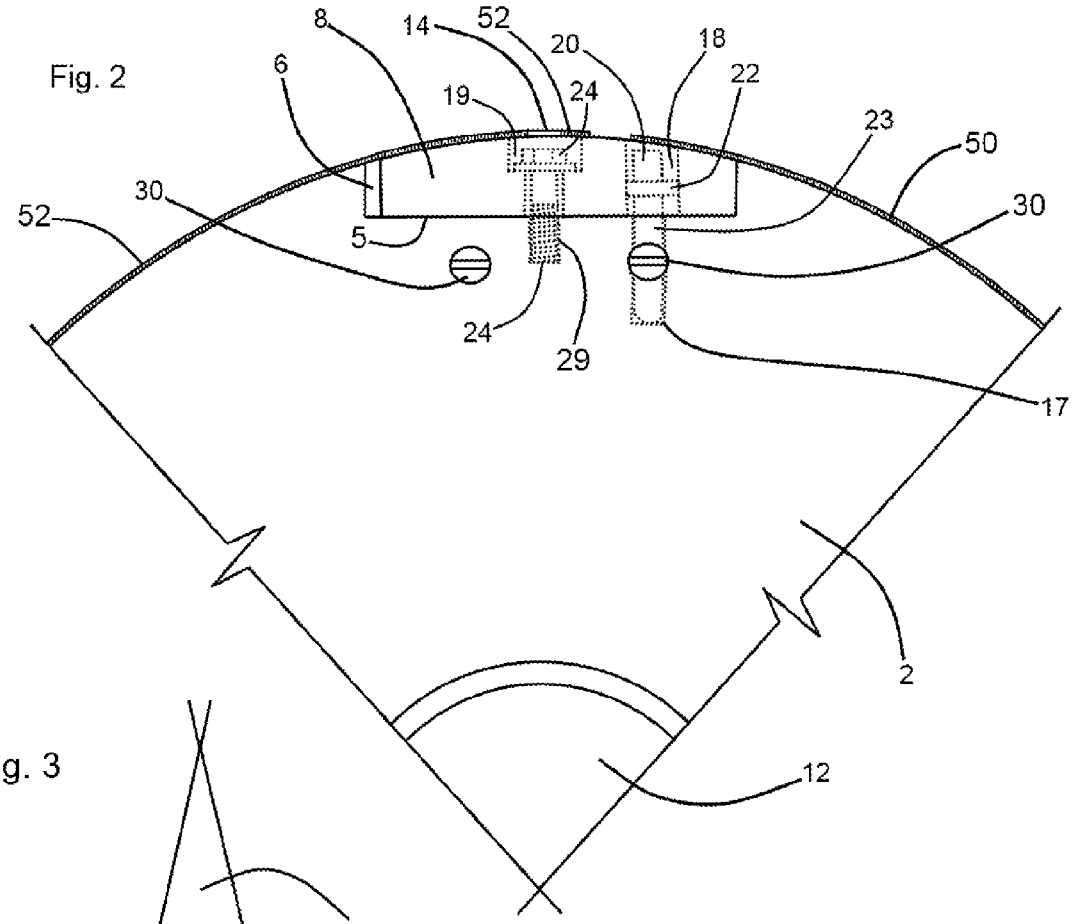
FIG. 2 is a partial end view of the preferred embodiment of the instant inventive magnetic roll, the view showing attached ferro-magnetic plates in sectional view, and further showing subsurface structural components in dotted lines.

Referring now to the drawings, and in particular to Drawing FIGS. 1 and 2, a preferred embodiment of the instant inventive magnetic roll is referred to generally by Reference Arrow 1. The magnetic roll 1 has axially and oppositely axially extending journal axles 12, and the roll 1 has a major cylindrical body segment 2.

Referring further simultaneously to FIGS. 1 and 2, the outer circumferential surface of the major cylindrical body segment 2 of the roll 1 is preferably milled to present a multiplicity of radially outwardly opening magnet receiving concavities 3, such concavities 3 having multiplicities of permanent magnets 4 adhesively embedded therein. In the preferred embodiment, the polarities of the permanent magnets 4 are oriented axially, and with alternatingly in " . . . NN, SS, NN, SS, NN . . . " patterns. Also in the preferred embodiment, mild steel pole piece magnet components are adhesively embedded between the permanent magnet components of the magnets, such pole pieces enhancing the density of the ferro-magnetic plate attaching magnetic flux which emanates from the circumferential surface of the cylindrical body segment 2.

Figure 3:
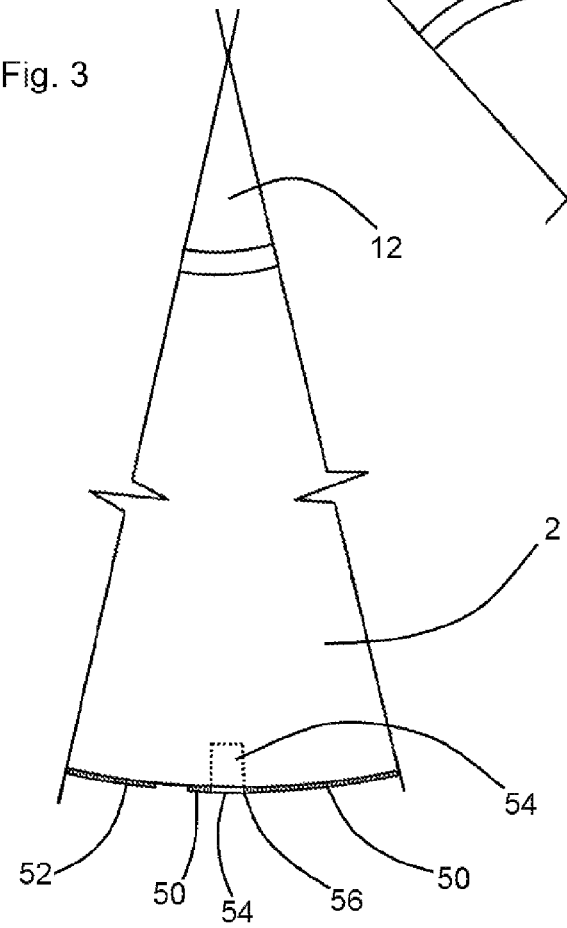
FIG. 3 is an alternative partial end view.
Figure 4:
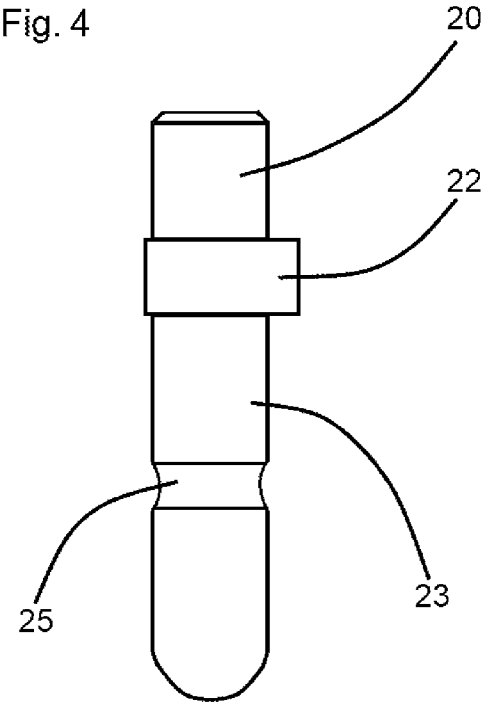
FIG. 4 is a side view of one of the rotatable cam members of the instant invention.
Figure 5:
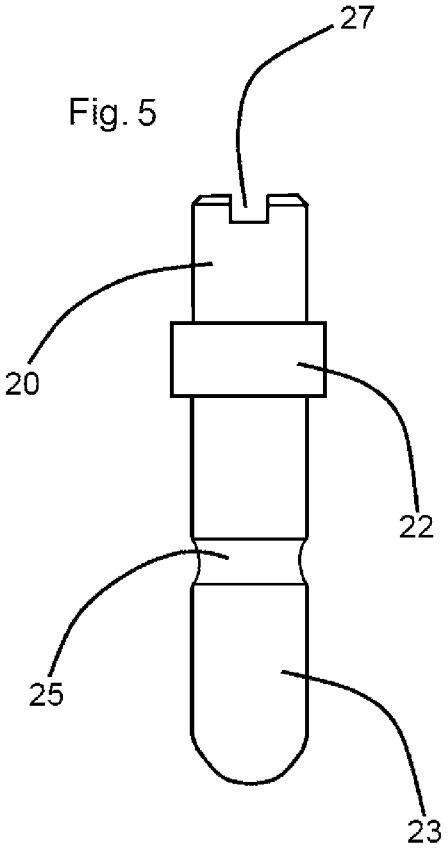
FIG. 5 redepicts FIG. 4, the view of FIG. 5 showing a circular cam element rotated ninety degrees.
Figure 6:
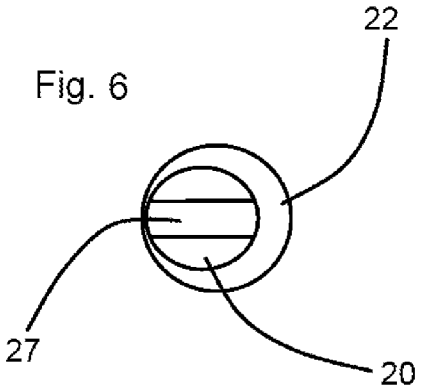
FIG. 6 is an upper plan view of the rotatable cam member of FIG. 4.

Referring simultaneously to FIGS. 1-3, a first ferro-magnetic and flexible printing plate, embossing plate, or sheet cutting die plate 50 may be initially magnetically attached upon the circumferential surface of the body segment 2. As can be seen in FIGS. 2 and 3, such flexible plate 50 extends half the circumference or semi-circumferentially about the roll 1. In order to achieve a proper alignment of such flexible plate 50, fixed position plate edge aligning means in the form of register pin receiving eyes 56 extending through a leading or trailing edge of the plate 50 are provided. Such eyes 56 may be placed over and may receive the exposed radially outer ends of register pins 54, the fixed position plate edge aligning means further comprising such pins 54. As is shown by the subsurface structure indicating dotted lines appearing on FIG. 3, the register pins 54 which serve to properly align the flexible plate 50 are securely and immovably mounted within the circumferential surface of the roll 1. Where only one flexible plate is to be magnetically attached, such immovable mounting of the register pins 54 is typically found to be acceptable because conventional printing presses which receive and rotatably drive print rolls such as the magnetic roll 1 typically include roll positioning adjustment mechanisms which allow for precise and accurate positioning of the roll and of its fixed register pins 54. Such printing press actuated roll positioning conventionally mechanically translates into means for properly positioning and aligning of a single magnetically attached flexible plate 50.

However, as can be seen in FIGS. 2 and 3, a second matching and corresponding flexible printing, embossing, or sheet cutting die plate 52 may be simultaneously installed semi-circumferentially over the roll 1. If a second set of fixed and immovable register pins, similar to pins 54, were antipodally mounted upon the roll 1, the above described mode of printing press actuated alignment of the pins 54 would not necessarily result in proper positioning and alignment of such antipodally mounted register pins. The printing press's conventional capacity for mechanical adjustment of the alignment of the first semi-circumferential roll 50 will not necessarily properly align such second semi-circumferential plate 52. Yet, magnetic attachment of such semi-circumferential plates is often necessary, and alignment difficulties often arise in relation to positioning of such second plate. The mechanism of the instant invention solves or ameliorates such plate alignment difficulties.

Referring simultaneously to FIGS. 1 and 2, the instant invention's primary means for ameliorating the above described printing plate alignment difficulties include a division or segmentation of the magnetic roll's cylindrical body to include a first cylindrical body segment 8, and a second or major cylindrical body segment 2. The second body segment 2 is preferably specially adapted to present a radially outwardly opening plate receiving channel 6, such channel 6 having a substantially flat floor 5.

Referring simultaneously to FIGS. 1 and 2, the first cylindrical body segment 8 is preferably configured as a slide plate whose radially inner surface is flat for abutting contact with and for sliding motion over the flat floor 5 of the channel 6. The radially outer surface of the first body segment 8 is preferably arcuately curved, its radius of curvature preferably matching that of the circumferential surface of the second body segment 2. In order to accommodate position and alignment adjusting movements of the first body segment 8 in the circumferential direction, the circumferential dimension of such first body segment 8 is preferably slightly less than that of the channel 6.

Referring further simultaneously to FIGS. 1 and 2, segment positioning means are preferably connected operatively to the first body segment 8, such means being adapted for slidably and adjustably moving the first body segment 8 to various positions and alignments within the channel 6. In the preferred embodiment, such means comprise at least a first, and preferably a plurality of rotatable cam and socket combinations. Such combinations are referred to generally in FIG. 2 by Reference Numerals 18, 20, and 22.

Referring simultaneously to FIGS. 2, 4, 5, and 6, each of the rotatable cam members of the rotatable cam and socket combinations 9 preferably comprises an axle shaft or post 23, such post 23 having an upper extension 20 and a screw driver bit receiving slot 27. Each of the rotatable cam members preferably further has a circular cam 22 whose center is displaced radially away from the axis of rotation of the post 23. Each post 23 preferably further has a frictional set screw engagement channel 25. The lower end of each of the posts 23 is preferably received within and rotates within a socket 17 to form a post and socket combination cam mount. Each of the sockets 17 (preferably four in number) preferably opens at the floor 5 of the channel 6.

Referring simultaneously to FIGS. 1, 2, 4, 5, and 6, while the posts 23 of the rotatable cam members rotate within sockets 17, those members' circular cam components 22 simultaneously rotate within slots 16 or within slots 18, each of such slots 16 and 18 preferably extending in the radial direction completely through body segment 8. Each of the slots 16 and 18 is preferably oblongated, their non-oblongated dimensions preferably being closely fitted to the outside diameters of the circular cam components 22. As a result of such close fitting of the circular cam components 22 with the narrow dimension of the slots 16 and 18, and as a result of the off axis positioning of the circular cam components 22, co-rotations of the posts 23 and their cams 22 tend to reciprocatingly slidably move the body segment 8. The directions of the oblongations of the slots 16 and 18 are preferably orthogonal with respect to each other so that the oblongation of one pair of slots permits motion induced by cam rotations within the other pair of slots, and vice versa.

Referring to FIGS. 1 and 2, an operator of the instant inventive magnetic roll 1 may wish to reposition the body segment 8 downwardly according to the perspective of FIG. 1 (or rightwardly according to the perspective of FIG. 2). In order to accomplish such body segment repositioning, the operator may wield a pair of screw drivers (not depicted within views) and may engage the bits of the screw drivers within the screw driver slots 27 which are exposed at the rotatable cam and socket combinations 9. Thereafter, the operator may simultaneously rotate both screw drivers ninety degrees in the clockwise direction, causing the circular cams 22 residing within slots 18 to rotate from the position depicted in FIGS. 1 and 5 to the position depicted in FIGS. 2 and 4, such rotations driving the circular cams 22 against the lower or rightward walls of oblongated slots 18, and slidably moving the cylindrical body portion 8 from the position depicted in FIG. 1 to the downwardly or rightwardly displaced position depicted in FIG. 2. Opposite rotation of such cams would oppositely drive the body segment 8. During all simultaneous rotations of such rotatable cam members residing within slots 18, the orthogonally extended dimensions of slots 16 serve to permit the cam driven circumferentially directed motion. Conversely, simultaneous rotations of the rotatable cam members 22 residing within slots 16 may adjustably move the body segment 8 in the axial or oppositely axial direction. Coordinated turnings of the four rotatable cam members 22 allows for a range of precise and infinitely variable positioning of the body segment 8 over the floor 5 of the channel 6.

In a suitable alternate configuration, and for the sake of economy in components and structure, only a single circumferentially oblongated slot 16 and rotatable cam combination may be provided and utilized, such single combination providing all needed axial sliding motion of the body segment 8.

Plate end aligning means in the form of register pins 14 are preferably fixedly mounted upon the first cylindrical body segment 8 in the same manner as the fixed position register pins 54 described above. Adjustable movements of the cylindrical body segment 8 actuated by selective rotations of the circular cams 22 advantageously moves, positionably adjusts, and aligns the register pins 14.

Referring to FIGS. 1 and 2, the means for positioning the cylindrical body member 8 preferably further comprise releasable locking means, such means preferably comprising an axially paired combination of a helically threaded bolt 24, a helically threaded socket 29, and body segment travel accommodating bolt receiving eye 19. The bolt receiving eyes 19 preferably have a diameter slightly greater than the outside diameter of the bolt 24, such diameter differential accommodating the above described sliding movement of the body segment 8 over the channel floor 5. Such travel accommodating eye 19 preferably presents and annular ledge or shelf against which a washer 21 may be compressively driven by the head of the bolt 24. Upon precise aligning and positioning of the body segment 8 through turning of the rotatable cam members 22, tightening of bolts 24 effectively secures the cylindrical body segment 8 at a desired position and alignment.

Referring simultaneously to FIGS. 1, 2, 4, and 5, in order to resist radial extractions of the rotatable cam members and in order to resist free turning rotations of such members, helically threaded set screws 30 are preferably provided, such screws extending in the axial direction through helically threaded channels. Such channels are preferably oriented for directing the axially inner ends 31 of the set screws 30 toward the set screw engaging channels 25 which extend annularly about the posts 23 of the rotatable cam members. In a preferred embodiment, such set screws 30 have a durable Teflon plastic inner end for engagement with and frictional sliding contact along such channels 25.

Referring to FIGS. 2 and 3, it can be seen that leading and trailing ends of flexible ferro-magnetic plates 50 and 52 reside at and are magnetically attached at the portion of the magnetic roll's annular surface which is represented by the circumferential outer surface of the cylindrical body segment 8. Referring further to FIG. 1, it can be seen that the roll's overall array of embedded permanent magnets is substantially continued in an uninterrupted fashion along such body segment 8. The continuity of the magnet array over segment 8 advantageously accommodates installations a pair of register pins along with multiple positioning means components and mechanisms including four rotatable cam member and oblongated slot combinations and two position locking bolt and eye combinations. By continuing the magnet array over the surface of body segment 8, ample wall edges between the concavities 3 are exposed at the circumferential surface and are made available for locations such components.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope commensurate with the appended claims.

I claim:

1. A roll for supporting at least a first flexible printing, embossing, or sheet cutting plate, the roll having a rotational axis and an outer circumferential surface, the roll comprising:

(a) a first body segment comprising a slide plate having an outer radial surface curved about the rotational axis;

(b) a second body segment comprising a cylindrical body having an outer surface curved about the rotational axis, the cylindrical body having an outwardly opening channel having a floor, the slide plate being received within the outwardly opening channel;

(c) a first plurality of magnet receiving concavities formed in the outer radial surface of the slide plate and a first plurality of magnets mounted within said concavities, said the first plurality of concavities opening at the slide plate's outer radial surface and the first plurality of magnets emitting plate attaching magnetic flux from the slide plate's outer radial surface, the outer radial surface having portions located between respective pairs of concavities;

(d) a second plurality of magnet receiving concavities and a second plurality of magnets received within the second plurality of concavities, the second plurality of magnets further emitting plate attaching magnetic flux from the cylindrical body's outer surface;

(e) a plurality of plate edge aligning pins, each plate edge aligning pin being fixedly attached to and extending outwardly from the outer radial surface; and (f) segment positioning cam, axle, and socket combinations, each of said combinations' sockets opening at one of the portions of the outer radial surface, each of said combinations operatively interconnecting the slide plate and the cylindrical body and each of said combinations being adapted for selectively positioning and repositioning the slide plate in unison with the first plurality of magnet receiving concavities, in unison with the first plurality of magnets, and in unison with the plate edge aligning pins, said selective positioning and repositioning comprising movements of the slide plate with respect to the cylindrical body.

2. The roll of claim 1 wherein the segment positioning cam, axle, and socket combinations are adapted for slidably moving the slide plate over the floor of the cylindrical body's outwardly opening channel.

3. The roll of claim 2 wherein the cam, axle, and socket combinations' cams are rotatable and are adapted for impelling the slide plate's sliding movement over the outwardly opening channel's floor.

4. The roll of claim 3 wherein the cam, axle, and socket combinations' sockets are oblongated and wherein paired sockets among said combinations' sockets are oriented orthogonally with respect to each other, each of said oblongated sockets permitting movement of the slide plate in the direction of its oblongation.

5. The roll of claim 4 wherein the oblongation of a first socket among the cam, axle, and socket combinations' sockets is directed axially, and wherein the oblongation of a second socket among said combinations' sockets is directed circumferentially.

6. The roll of claim 5 wherein each cam, axle, and socket combination further comprises an axle receiving socket, each axle receiving socket opening at the outwardly opening channel's floor, and wherein each axle extends radially outwardly from the outwardly opening channel's floor.

7. The roll of claim 3 further comprising releasable locking means, the releasable locking means further interconnecting the slide plate and the cylindrical body.

8. The roll of claim 7 wherein the releasable locking means comprise a combination of a helically threaded bolt, a helically threaded socket, and a slide plate travel accommodating eye.

9. The roll of claim 8 wherein each slide plate travel accommodating eye extends through the slide plate.

10. The roll of claim 9 further comprising a plurality of helically threaded socket and helically threaded set screw combinations, each combination among the plurality of helically threaded socket and helically threaded set screw combinations being adapted for resisting rotation of one of the cams among the cam, axle, and socket combinations' cams.

* * * * *